US005219219A

United States Patent [19]

Virdin, Jr.

[11] Patent Number: 5,219,219

[45] Date of Patent: Jun. 15, 1993

[54] TRASH BAG TABLE COVER

[76] Inventor: Kenneth A. Virdin, Jr., P.O. Box 104, Clayton, Del. 19938

[21] Appl. No.: 791,344

[22] Filed: Nov. 14, 1991

[51] Int. Cl.[5] ..... B65D 30/10; B65D 33/25; B65D 33/28

[52] U.S. Cl. ..... 383/4; 383/63; 383/65; 383/66; 383/75; 206/541; 150/158

[58] Field of Search ..... 383/4, 61, 63, 65, 66, 383/38, 107, 108, 127, 72, 75; 206/541, 542, 548, 549, 225; 150/158

[56] References Cited

U.S. PATENT DOCUMENTS

| | | | |
|---|---|---|---|
| 2,789,609 | 4/1957 | Post | 383/65 |
| 3,097,782 | 7/1963 | Koropatkin et al. | 206/549 X |
| 3,503,759 | 3/1970 | Wilton | 383/38 X |
| 4,337,812 | 7/1982 | Trinkner | 383/4 |
| 4,542,050 | 9/1985 | Gallant | 383/127 X |
| 4,634,618 | 1/1987 | Greer et al. | 383/127 X |
| 4,709,430 | 12/1987 | Nicoll | 383/4 X |
| 4,738,545 | 4/1988 | Westgor | 383/4 |
| 4,895,742 | 1/1990 | Schaub et al. | 383/4 X |
| 4,915,232 | 4/1990 | Hill et al. | 206/541 |
| 4,938,607 | 7/1990 | Kelley | 383/4 |

FOREIGN PATENT DOCUMENTS

| | | | |
|---|---|---|---|
| 1079480 | 11/1954 | France | 383/63 |

*Primary Examiner*—Allan N. Shoap
*Assistant Examiner*—Jes F. Pascua
*Attorney, Agent, or Firm*—Leon Gilden

[57] ABSTRACT

A flexible polymeric fluid impermeable cover includes a first web secured to and coextensive with a second web at a coextensive inter-relationship. A peripheral conduit is formed about the perimeter of the first and second web to contain a respective first and second continuous drawstring, wherein each drawstring is projecting exteriorly of the cover through opposed and respective first and second sides. A modification of the invention includes the web structure including a pocket accessible through a zipper to contain food debris therewithin in an alternative use relative to the drawstring structure to secure the bag about food debris and may further include a continuous fluid filled chamber positioned interiorly and adjacent the drawstring conduit to contain a fluid therewithin, wherein the fluid is utilized to stabilize the cover during use, as well as permitting access to fluid for cleaning of the table subsequent to its use. A carrying case structure is provided to provide ease of transport of the organization.

3 Claims, 4 Drawing Sheets

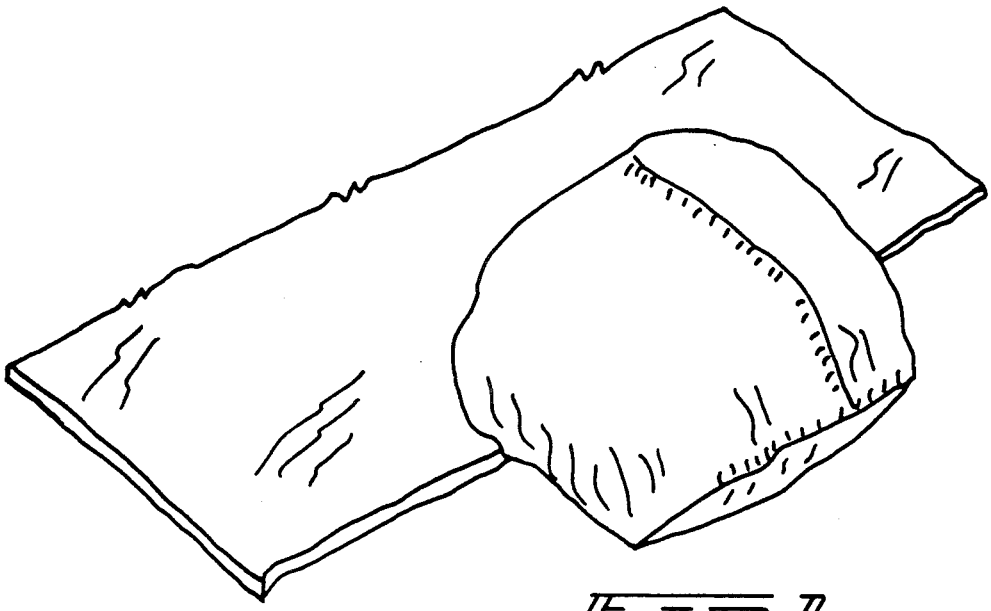
FIG 1
PRIOR ART
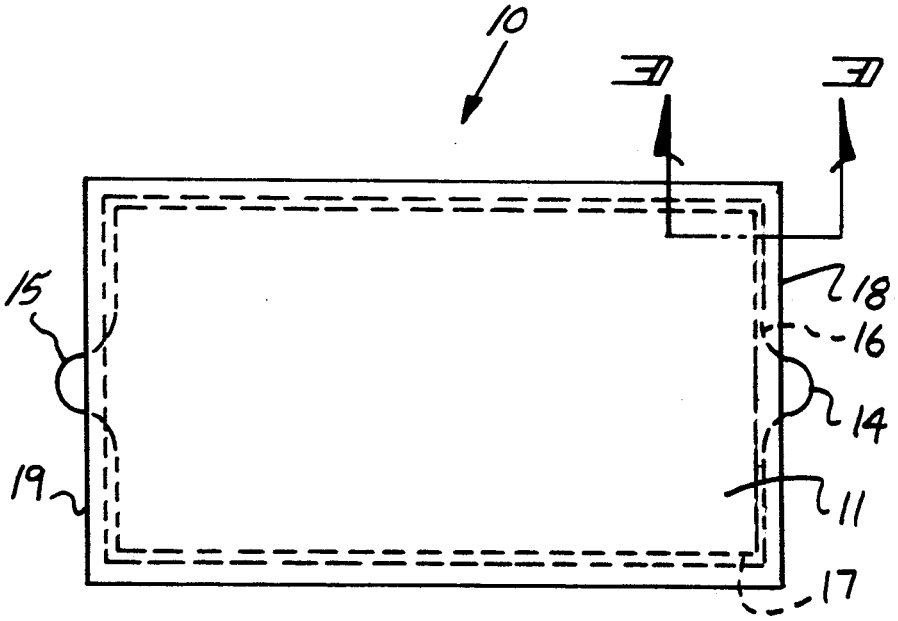
FIG 2
FIG 3
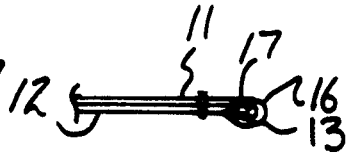

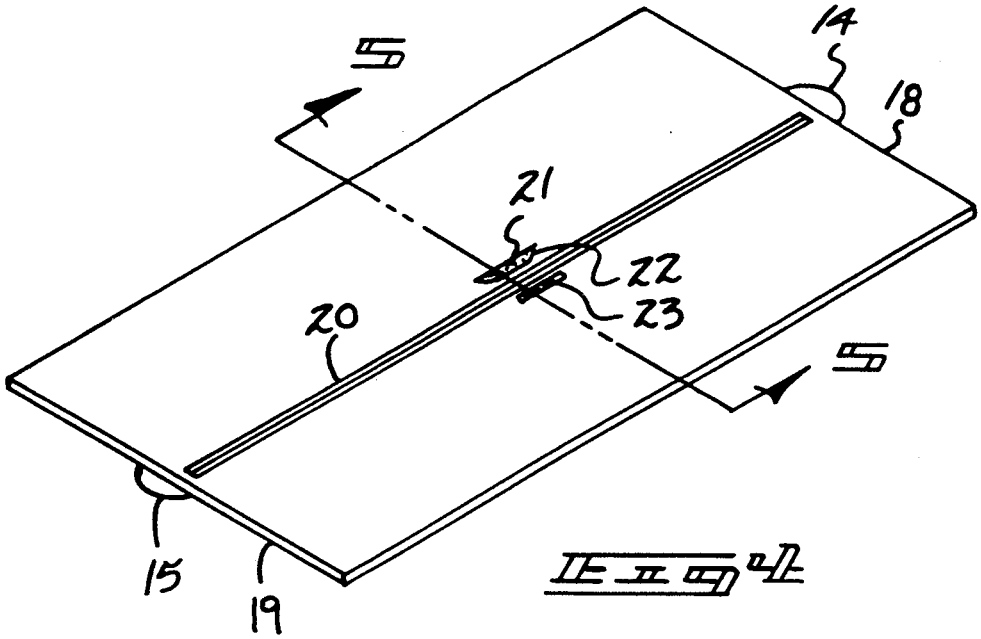
FIG 4
FIG 5
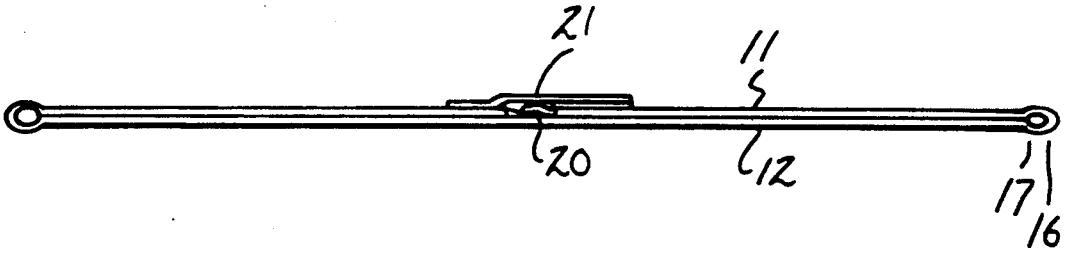
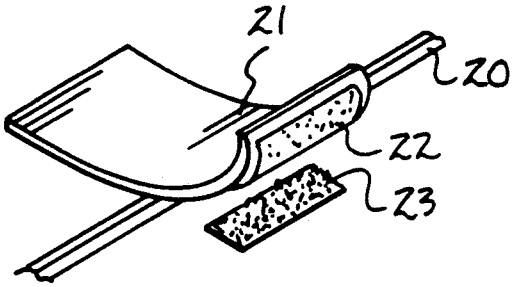
FIG 6

TRASH BAG TABLE COVER

BACKGROUND OF THE INVENTION

1. Field of the Invention

The field of invention relates to trash bag apparatus, and more particularly pertains to a new and improved trash bag table cover wherein the same is arranged for positioning to a top surface of a table during use and may be subsequently assembled in a bag-like structure to permit ease of disposal of food debris and components subsequent to an eating or dining procedure.

2. Description of the Prior Art

The prior art has utilized a disposable table covering, as set forth in U.S. Pat. No. 4,542,050 to Gallant wherein during and subsequent to a picnicking, the bag-like structure is utilized as a garbage bag, wherein remains of the meal may be positioned for proper disposal.

U.S. Pat. No. 3,960,193 to Davis sets forth a table cloth utilizing weighted members mounted to edges thereof for maintaining the material on the table in use.

U.S. Pat. No. 4,923,453 to Bullard, Jr. sets forth an absorbent disposable cover for use on x-ray tables for absorption of fluid materials.

As such, it may be appreciated that there continues to be a need for a new and improved trash bag table cover as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of trash bag apparatus now present in the prior art, the present invention provides a trash bag table cover wherein the same is arranged for positioning upon a top surface of a picnic table, wherein the organization may be gathered about its periphery to enclose food and debris subsequent to a dining event. As such, the general purpose of the present invention, which will be described subsequently in greater detail, is to provide a new and improved trash bag table cover which has all the advantages of the prior art trash bag apparatus and none of the disadvantages.

To attain this, the present invention provides a flexible polymeric fluid impermeable cover including a first web secured to and coextensive with a second web at a coextensive inter-relationship. A peripheral conduit is formed about the perimeter of the first and second web to contain a respective first and second continuous drawstring, wherein each drawstring is projecting exteriorly of the cover through opposed and respective first and second sides. A modification of the invention includes the web structure including a pocket accessible through a zipper to contain food debris therewithin in an alternative use relative to the drawstring structure to secure the bag about food debris and may further include a continuous fluid filled chamber positioned interiorly and adjacent the drawstring conduit to contain a fluid therewithin, wherein the fluid is utilized to stabilize the cover during use, as well as permitting access to fluid for cleaning of the table subsequent to its use. A carrying case structure is provided to provide ease of transport of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash bag table cover which has all the advantages of the prior art trash bag apparatus and none of the disadvantages.

It is another object of the present invention to provide a new and improved trash bag table cover which may be easily and efficiently manufactured and marketed.

It is a further object of the present invention to provide a new and improved trash bag table cover which is of a durable and reliable construction.

An even further object of the present invention is to provide a new and improved trash bag table cover which is susceptible of a low cost of manufacture with regard to both materials and labor, and which accordingly is then susceptible of low prices of sale to the consuming public, thereby making such trash bag table covers economically available to the buying public.

Still yet another object of the present invention is to provide a new and improved trash bag table cover which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a prior art trash bag cover that is used in association with a table top in a picnic event.

FIG. 2 is an orthographic top view of the instant invention.

FIG. 3 is an orthographic view taken along the lines 3—3 of FIG. 2 in the direction indicated by the arrows.

FIG. 4 is an isometric illustration of a modified aspect of the invention.

FIG. 5 is an orthographic view, taken along the lines 5—5 of FIG. 4 in the direction indicated by the arrows.

FIG. 6 is an isometric illustration of the flap structure utilized to permit ease of disassembly of the zipper member utilized by the trash bag as set forth in FIG. 4.

DESCRIPTION OF THE PREFERRED EMBODIMENT

Figure 7:
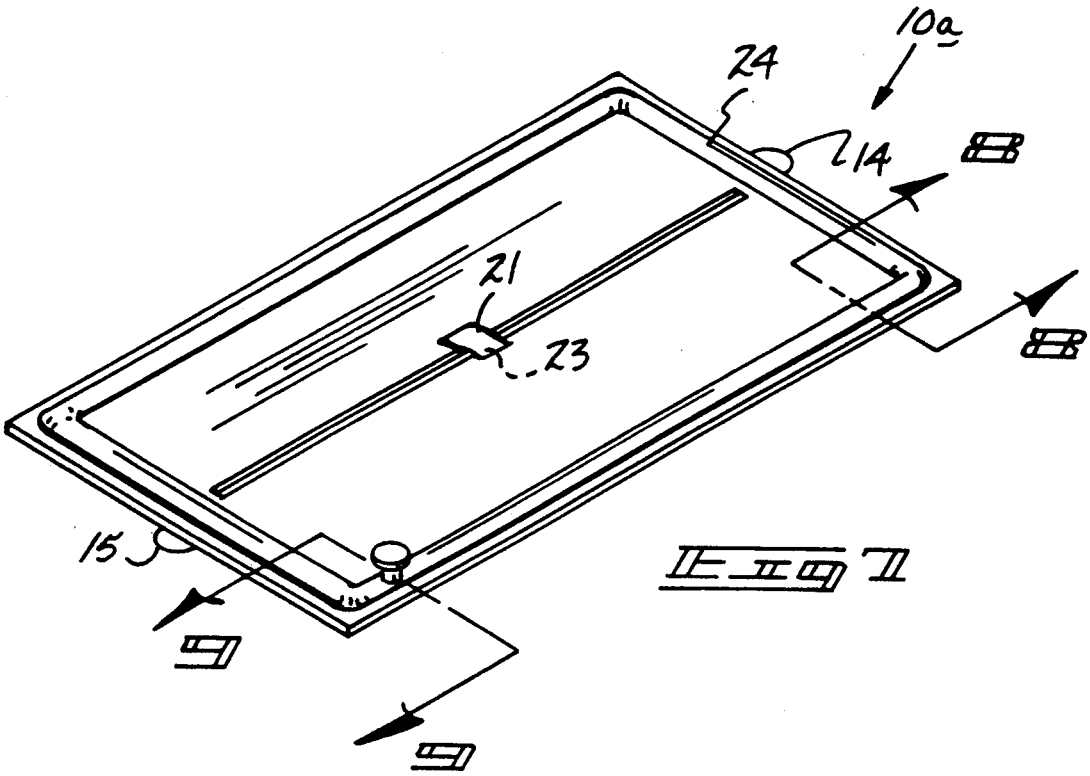
FIG. 7 is an isometric illustration of a further modification of the invention.

With reference now to the drawings, and in particular to FIGS. 1 to 11 thereof, a new and improved trash bag table cover embodying the principles and concepts of the present invention and generally designated by the reference numerals 10 and 10*a* will be described.

Figure illustrates a prior art trash bag table cover, as set forth in U.S. Pat. No. 4,542,050 wherein the same is arranged for positioning upon a table during a picnic event, wherein the bag-like structure includes a means for association and assemblage of the bag for disposal of food and various picnic debris.

More specifically, the trash bag table cover 10 of the instant invention essentially comprises a first web 11 that is contiguous with and coextensive with a second web 12. A peripheral conduit 13 joins the first and second webs at their outer perimeter webs, wherein the conduit includes a respective first and second drawstring 16 and 17 slidably contained within the peripheral conduit. A first drawstring handle 14 and a second drawstring handle 15 project medially and exteriorly of a respective first and second side edge 18 and 19 of the cover organization. In this manner, the cover 10 may be positioned upon a table top, in a manner such as exemplified in FIG. 10, whereupon subsequent to a dining event, pulling of the drawstring handles 14 and 15 exteriorly of the respective first and second side edges 18 and 19 effects a gathering of the drawstrings into a restricted configuration to contain components of the dining event within the top surface of the first web 11.

FIG. 4 illustrates the use of an interlocking zipper seam 20 extending substantially between the first and second side edges 18 and 19 projecting medially and orthogonally relative to the first and second side edges. To effect ease of opening of the seam structure to permit positioning of debris within a cavity defined between the first and second webs 11 and 12, a flap member 21 is fixedly mounted adjacent a first side of the seam, wherein the flap member is arranged for manual pulling, whereupon securement of a second side of the top web effects a separation of the zipper seam. The flap member 21 includes a first hook and loop fastener patch 22 formed at a distal end thereof for cooperation with a second hook and loop fastener patch 23 mounted to the first hook on the second side of the seam.

Figure 8:
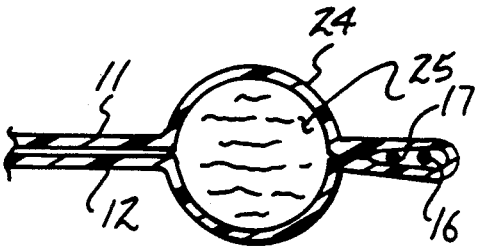
FIG. 8 is an orthographic view, taken along the lines 8—8 of FIG. 7 in the direction indicated by the arrows.
Figure 9:
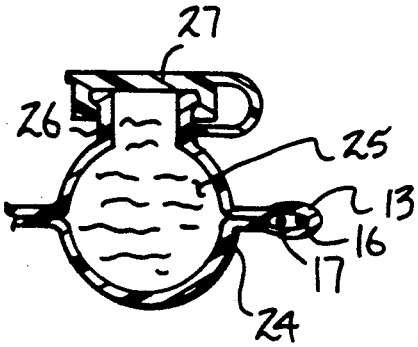
FIG. 9 is an orthographic view, taken along the lines 9—9 of FIG. 7 in the direction indicated by the arrows.
Figure 10:
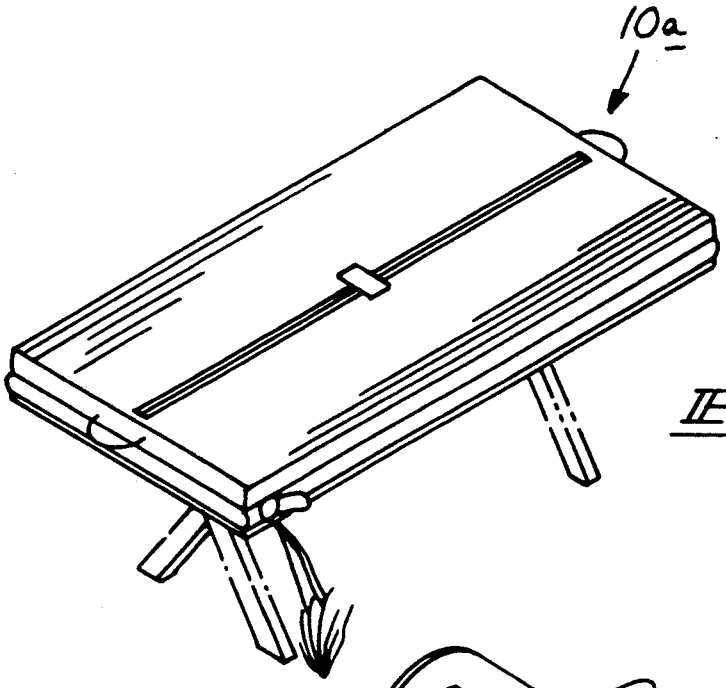
FIG. 10 is an isometric illustration of the organization in use.

The FIGS. 7–9 illustrate the use of a continuous chamber 24 formed between the first and second webs 11 and 12 adjacent to the peripheral conduit 13. Fluid 25, such as water or cleaning solution, is contained within the chamber 24 to provide ballast and securement of the organization when positioned upon a table top, as illustrated in the FIG. 10 for example. Subsequent to an eating event, the fluid 25 may be expressed from the chamber 24 through a chamber fill conduit nipple 26. The fluid 25 may be thereafter utilized to effect a cleaning of an individual's hands as well as the table should such be required. Fluid is expressed through the chamber fill conduit nozzle 26 that is normally secured by a cap member 27.

Figure 11:
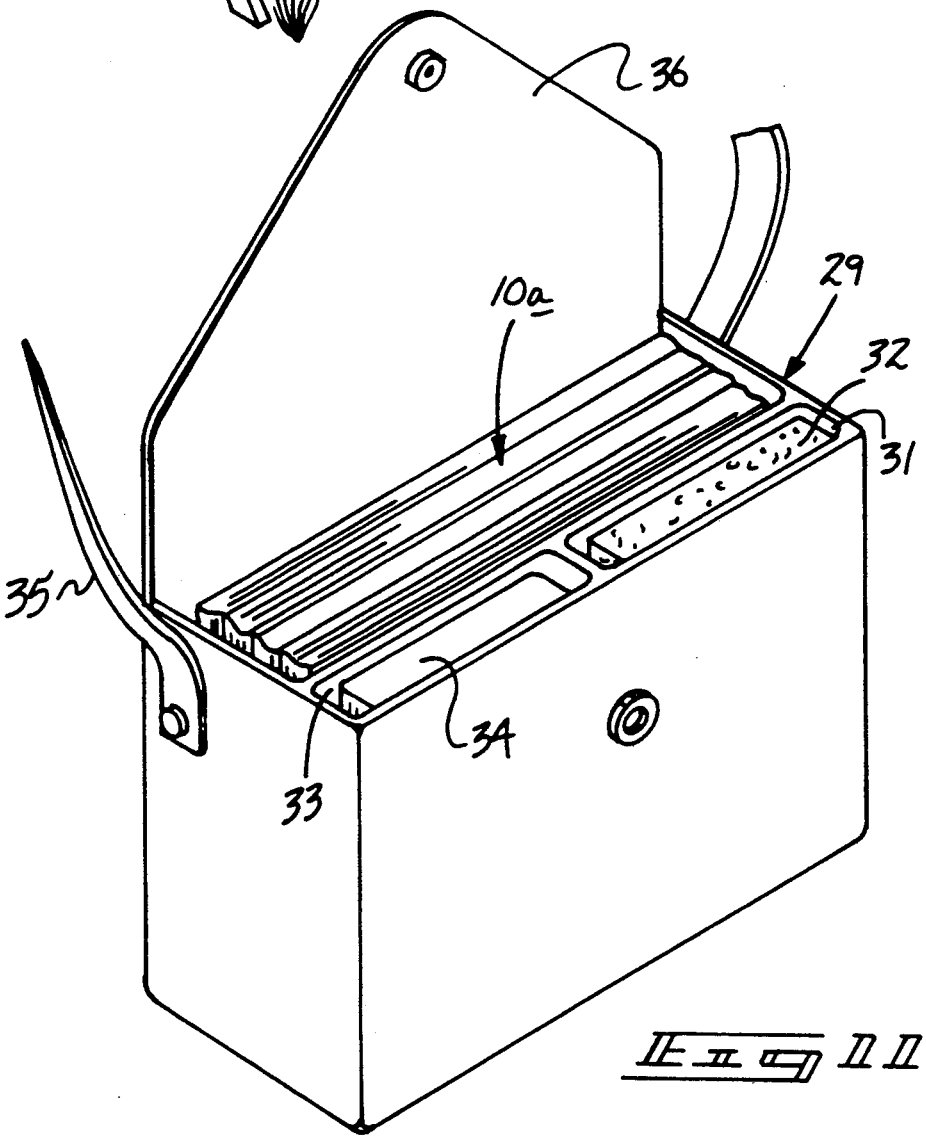
FIG. 11 is an isometric illustration of a transport bag utilizing various compartments for storage of the table cloth structure in association with cleaning components.

For ease of transport and utilization of the cover 10*a*, a transport container 29 is provided. The transport container, as illustrated in FIG. 11, includes a first cavity 30 for receiving the cover 10*a* therewithin. A second cavity 31 and a third cavity 33 are positioned within the transport container 29 adjacent the first cavity 30 to include a respective sponge 32 and soap 34 to assist in a cleaning event for use in cooperation with the fluid 25 contained within the chamber 24. A cover flap 36 is provided and hingedly mounted to a rear wall of the transport container and secured to a forward wall of the transport container. A flexible strap member 35 is pivotally mounted to side walls of the container for ease of transport and positioning of the strap member about an individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trash bag table cover organization, comprising, a cover web, including a first web contiguous with and coextensive with a second web, the cover web including a first side edge spaced from and parallel a second side edge, and a peripheral conduit directed through the cover web, wherein the peripheral conduit includes a first drawstring and a second drawstring slidably mounted within the peripheral conduit, and a first drawstring handle, the first drawstring projecting exteriorly of the cover web through the first side edge, and a second drawstring handle defining the second drawstring extending exteriorly of the cover web exteriorly of the second side edge, wherein the first drawstring and the second drawstring are slidably mounted within the peripheral conduit to permit the first drawstring handle and the second drawstring handle to be extended exteriorly of the cover web for a gathering of the perimeter of the cover web, and the first web includes an interlocking zipper seam extending substantially orthogonally between the first side edge and the second side edge permitting opening of the seam for access between the first web and the second web, and a flap member, the flap member mounted to a first side of the seam on the first web, and the flap member including a flap member distal end, the flap member distal end including a first hook and loop fastener patch, and a second hook and loop fastener patch mounted to the first web on a second side of the seam to permit securement of the flap member to the second hook and loop fastener patch, whereupon manual grasping and pulling of the flap member relative to the second side of the seam enhances separation of the seam for access between the first web and the second web.

2. A table cover organization as set forth in claim 1 wherein a continuous fluid impermeable chamber is formed between the first web and the second web adjacent the peripheral conduit, the chamber including a fluid contained therewithin, and the chamber including a chamber fill conduit nozzle directed into the chamber, wherein the nozzle includes a cap member selectively removable from the nozzle to permit selective filling or emptying of the chamber.

3. A table cover organization as set forth in claim 2 including a transport container, the transport container including a first side wall and a second side wall, and a rear wall and a forward wall, the rear wall including a cover flap hingedly mounted to the rear wall, and the cover flap selectively securable to the forward wall, and a flexible strap member mounted to the first side wall and the second side wall for ease of transport of the transport container, and a first cavity arranged for reception of the member, and a second cavity, the second cavity including a sponge contained therewithin, and the container including a third cavity, wherein the third cavity includes soap contained therewithin.

* * * * *